US008334886B2

(12) United States Patent
Sanbongi et al.

(10) Patent No.: US 8,334,886 B2
(45) Date of Patent: Dec. 18, 2012

(54) THERMAL HEAD AND PRINTER

(75) Inventors: Norimitsu Sanbongi, Chiba (JP); Noriyoshi Shoji, Chiba (JP); Toshimitsu Morooka, Chiba (JP); Keitaro Koroishi, Chiba (JP)

(73) Assignee: Seiko Instruments Inc. (JP)

( * ) Notice: Subject to any disclaimer, the term of this patent is extended or adjusted under 35 U.S.C. 154(b) by 196 days.

(21) Appl. No.: 12/804,723

(22) Filed: Jul. 28, 2010

(65) Prior Publication Data

US 2011/0025808 A1 Feb. 3, 2011

(30) Foreign Application Priority Data

Jul. 29, 2009 (JP) ..... 2009-176533

(51) Int. Cl.
*B41J 2/335* (2006.01)

(52) U.S. Cl. ..... 347/200; 347/202

(58) Field of Classification Search ..... 347/200, 347/205, 202

See application file for complete search history.

(56) References Cited

U.S. PATENT DOCUMENTS

| | | | | |
|---|---|---|---|---|
| 7,768,541 | B2 * | 8/2010 | Koroishi et al. | 347/202 |
| 7,852,361 | B2 * | 12/2010 | Shoji et al. | 347/206 |
| 7,956,880 | B2 * | 6/2011 | Shoji et al. | 347/202 |
| 8,111,273 | B2 * | 2/2012 | Morooka et al. | 347/204 |
| 8,122,591 | B2 * | 2/2012 | Shoji et al. | 29/611 |
| 8,144,175 | B2 * | 3/2012 | Koroishi et al. | 347/200 |
| 8,154,575 | B2 * | 4/2012 | Koroishi et al. | 347/207 |

FOREIGN PATENT DOCUMENTS

JP 2007-083532 * 4/2007

* cited by examiner

*Primary Examiner* — Huan Tran
(74) *Attorney, Agent, or Firm* — Adams & Wilks

(57) ABSTRACT

A thermal head has a support substrate, an upper plate substrate having a back surface bonded to a top surface of the support substrate, and a heating resistor provided on the upper plate substrate. A concave portion is formed in a region of at least one of the top surface of the support substrate and the back surface of the upper plate substrate and opposes the heating resistor. A through portion is formed in the upper plate substrate and passes through the upper plate substrate from a top surface of the upper plate substrate to the top surface of the support substrate in a plate thickness direction. The upper plate substrate functions as a heat accumulating layer, and the concave portion functions as a heat insulating layer.

13 Claims, 13 Drawing Sheets

THERMAL HEAD AND PRINTER

BACKGROUND OF THE INVENTION

1. Field of the Invention

The present invention relates to a thermal head and a printer including the thermal head.

2. Description of the Related Art

There has been conventionally known a thermal head used in a thermal printer to effect printing onto a thermosensitive recording medium by selectively driving a plurality of heating elements based on printing data (see, for example, patent document JP 2007-83532 A).

As a method for achieving a reduction in power consumption by improving thermal efficiency of a heating resistor in a thermal head, there has been known a method in which a hollow portion is formed in a region opposing the heating resistor. By allowing the hollow portion to function as a heat insulating layer having a low thermal conductivity, and reducing an amount of heat propagated and dissipated from the heating resistor to a support substrate, efficiency of energy used for printing may be improved.

Such a thermal head having a hollow portion is formed by providing a silicon substrate (lower plate substrate) with a concave portion by etching or laser processing, bonding a glass thin plate (upper plate substrate) serving as a heat accumulating layer onto the silicon substrate, and then processing the upper plate substrate to a desired thickness by polishing.

In such a thermal head having a hollow portion, when the thickness of an upper plate substrate which supports thereon a heating resistor is reduced to enlarge the hollow portion, heat insulating performance increases so that the thermal efficiency of the thermal head is improved. On the other hand, when the thickness of the upper plate substrate is reduced, the strength thereof decreases. Accordingly, in order to ensure a strength required to support the heating resistor while maintaining the thermal efficiency, thickness control over the upper plate substrate is important. Therefore, it is necessary to accurately perform the polishing of the upper plate substrate.

However, in the method disclosed in JP 2007-83532 A, when the two glass plates are bonded together, and then the upper plate substrate is polished to obtain a glass thin plate having a desired thickness, it is inevitable to measure the total thickness of the upper plate substrate and the lower plate substrate in a bonded state. Accordingly, variations in the thickness of the lower plate substrate are involved in the thickness of the upper plate substrate to be measured, which results in a problem of a reduction in accuracy of measuring the thickness of the upper plate substrate. In addition, the thickness is measured with a measurement device by pinching an outer edge portion of the substrate including the upper and lower plate substrates bonded together, and hence a problem arises that only the thickness of the outer edge portion of the substrate may be measured.

SUMMARY OF THE INVENTION

The present invention has been made in view of the foregoing circumstances, and an object of the present invention is to provide a thermal head and a printer in which, even when an upper plate substrate and a lower plate substrate are in a bonded state, a thickness of the upper plate substrate is adjusted to an appropriate value to allow an improvement in thermal efficiency.

In order to achieve the above-mentioned object, the present invention provides the following means.

The present invention adopts a thermal head, including: a support substrate; an upper plate substrate having a back surface thereof bonded to a top surface of the support substrate; a heating resistor provided on the upper plate substrate; a concave portion formed in a region of at least one of the top surface of the support substrate and the back surface of the upper plate substrate, which opposes the heating resistor; and a through portion formed in the upper plate substrate, which passes through the upper plate substrate from a top surface of the upper plate substrate to the top surface of the support substrate in a plate thickness direction.

The upper plate substrate provided with the heating resistor functions as a heat accumulating layer which accumulates therein heat generated from the heating resistor. The concave portion formed in at least one of the top surface of the support substrate and the back surface of the upper plate substrate forms a hollow portion when the support substrate and the upper plate substrate are bonded together. The hollow portion is formed in a region opposing the heating element, and functions as a heat insulating layer which shuts off heat generated from the heating resistor. Therefore, according to the present invention, it is possible to inhibit heat generated from the heating resistor from being propagated to the support substrate via the upper plate substrate to be dissipated, and improve a use ratio of heat generated from the heating resistor, that is, the thermal efficiency of the thermal head.

In the upper plate substrate according to the present invention, a through portion is provided, which passes through the upper plate substrate from the top surface thereof to the top surface of the support substrate in the plate thickness direction. Therefore, when a substrate obtained by bonding together the support substrate and the upper plate substrate is processed into a thin plate by polishing or the like, a thickness of only the upper plate substrate may be measured by inserting a measurement device such as a micrometer into the through portion.

That is, according to the present invention, it is possible to measure the thickness of only the upper plate substrate, which greatly affects the thermal efficiency of the thermal head, instead of measuring a total thickness of the substrate obtained by bonding together the upper plate substrate and the lower plate substrate as practiced conventionally. Accordingly, when the thickness of the upper plate substrate is measured, it is possible to prevent a measurement value from involving variations in the thickness of the lower plate substrate, and improve the accuracy of measuring the thickness of the upper plate substrate. Therefore, it is possible to adjust the thickness of the upper plate substrate to an appropriate value to ensure the strength thereof, improve the thermal efficiency of the thermal head, and reduce the amount of energy required for printing.

The thermal head according to the invention may further include a mark for alignment with the upper plate substrate, which is provided in the top surface of the support substrate at a position corresponding to the through portion of the upper plate substrate.

This allows accurate alignment between the support substrate and the upper plate substrate, and allows accurate alignment between the hollow portion formed between the support substrate and the upper plate substrate and the heating resistor provided on the upper plate substrate. Therefore, it is possible to improve heat insulating performance owing to the hollow portion, and improve the thermal efficiency of the thermal head.

The thermal head according to the invention may further include an air vent formed in the upper plate substrate, which passes through the upper plate substrate in the plate thickness direction.

This allows air bubbles (voids) sandwiched between the support substrate and the upper plate substrate to be discharged from the air vent provided in the upper plate substrate. As a result, the support substrate and the upper plate substrate may be brought into closer contact with each other at a portion other than the hollow portion. Therefore, it is possible to prevent the breakage or swelling of a portion with the air bubbles, and effect satisfactory formation of the head.

The thermal head according to the invention may further include a groove formed in at least one of the top surface of the support substrate and the back surface of the upper plate substrate at a position corresponding to the air vent of the upper plate substrate.

This allows air bubbles (voids) sandwiched between the support substrate and the upper plate substrate to be discharged from the air vent provided in the upper plate substrate via the groove formed in at least one of the top surface of the support substrate and the back surface of the upper plate substrate. As a result, it is possible to improve the adhesion between the support substrate and the upper plate substrate.

In the invention, the through portion may be provided at a cutting position used when a thermal head assembly in which a plurality of the heating resistors are provided on the upper plate substrate is cut and divided into a plurality of the thermal heads.

The through portion is opened in the top surface of the upper plate substrate, and hence is easy to recognize. Therefore, by using the through portion as the mark of the cutting position when the thermal head assembly is divided into the plurality of thermal heads, the accuracy of cutting may be improved.

Further, the present invention adopts a printer including the thermal head described above.

The printer includes the thermal head described above, and therefore it is possible to adjust the thickness of the upper plate substrate to an appropriate value to ensure the strength thereof, improve the thermal efficiency of the thermal head, and reduce the amount of energy required for printing.

According to the present invention, the effect is achieved that, even when the upper plate substrate and the lower plate substrate are in a bonded state, thermal efficiency may be improved by adjusting the thickness of the upper plate substrate to an appropriate value.

BRIEF DESCRIPTION OF THE DRAWINGS

In the accompanying drawings:

FIGS. 4A and 4B are views each illustrating a laminated substrate obtained by bonding together an upper plate substrate and a support substrate of FIG. 3, in which FIG. 4A is a plan view, and FIG. 4B is a cross-sectional view;

FIGS. 6A and 6B are cross-sectional views of the laminated substrate for illustrating a thin-plate processing step of FIG. 5, in which FIG. 6A illustrates a state where an amount of polishing is T0, and FIG. 6B illustrates a state where the amount of polishing is T1;

FIGS. 8A and 8B are views for illustrating a method of measuring an amount of polishing in a thin-plate processing step for a conventional thermal head, in which FIG. 8A illustrates a state before polishing, and FIG. 8B illustrates a state after polishing;

FIGS. 9A to 9C are views illustrating other embodiments of the laminated substrate, in which FIG. 9A is a plan view of a laminated substrate in which a plurality of thermal heads are arranged in adjacent relation with no gap provided therebetween, FIG. 9B is a plan view of a laminated substrate in which a single thermal head is provided, and FIG. 9C is a cross-sectional view thereof;

FIGS. 12A and 12B are partially enlarged views of through holes provided in four corners of the laminated substrate of FIG. 11, in which FIG. 12A is a plan view, and FIG. 12B is a cross-sectional view;

FIGS. 13A and 13B are views each illustrating a laminated substrate in a thermal head according to a third embodiment of the present invention, in which FIG. 13A is a plan view, and FIG. 13B is a cross-sectional view;

FIGS. 14A and 14B are views each illustrating a laminated substrate in the conventional thermal head, in which FIG. 14A is a plan view, and FIG. 14B is a cross-sectional view;

DETAILED DESCRIPTION OF THE INVENTION

First Embodiment

Figure 1:
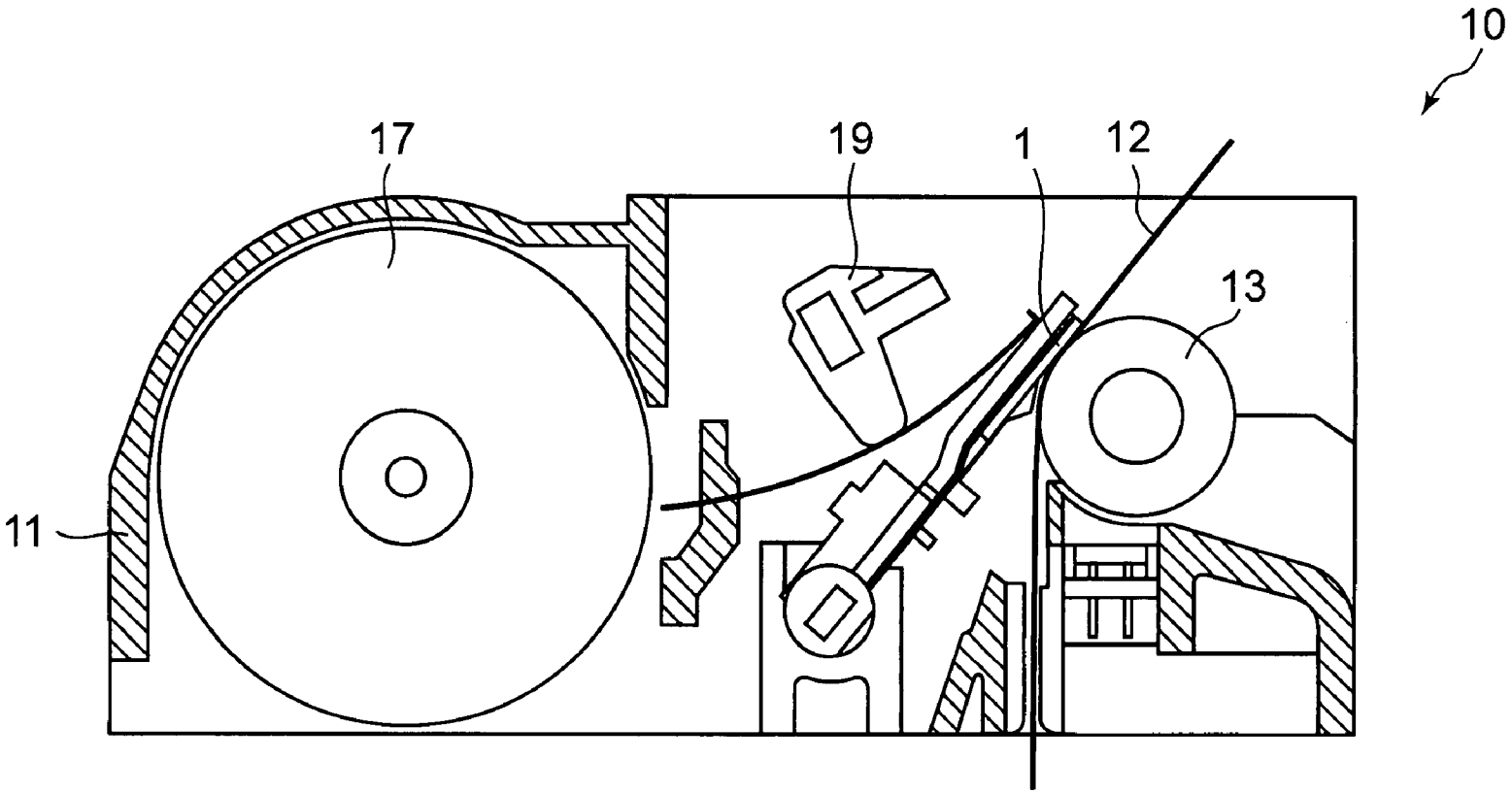
FIG. 1 is a schematic structural view of a thermal printer according to a first embodiment of the present invention.

Referring to the drawings, a thermal head 1 and a thermal printer 10 according to a first embodiment of the present invention are described.

The thermal head 1 according to this embodiment is used in the thermal printer 10 as illustrated in, for example, FIG. 1, and selectively drives a plurality of heating elements based on printing data to effect printing onto a printing target such as thermal paper 12 or the like.

The thermal printer 10 includes a main body frame 11, a platen roller 13 disposed horizontally, the thermal head 1 disposed oppositely to an outer peripheral surface of the platen roller 13, a heat dissipation plate 15 (see FIG. 3) supporting the thermal head 1, a paper feeding mechanism 17 for feeding the thermal paper 12 between the platen roller 13 and the thermal head 1, and a pressure mechanism 19 for pressing the thermal head 1 against the thermal paper 12 with a predetermined pressing force.

Against the platen roller 13, the thermal head 1 and the thermal paper 12 are pressed by the operation of the pressure mechanism 19. With this, load of the platen roller 13 is applied to the thermal head 1 through the thermal paper 12.

The heat dissipation plate 15 is a plate-shaped member made of metal such as aluminum, a resin, ceramics, glass, or the like, and serves for fixation and heat dissipation of the thermal head 1.

Figure 2:
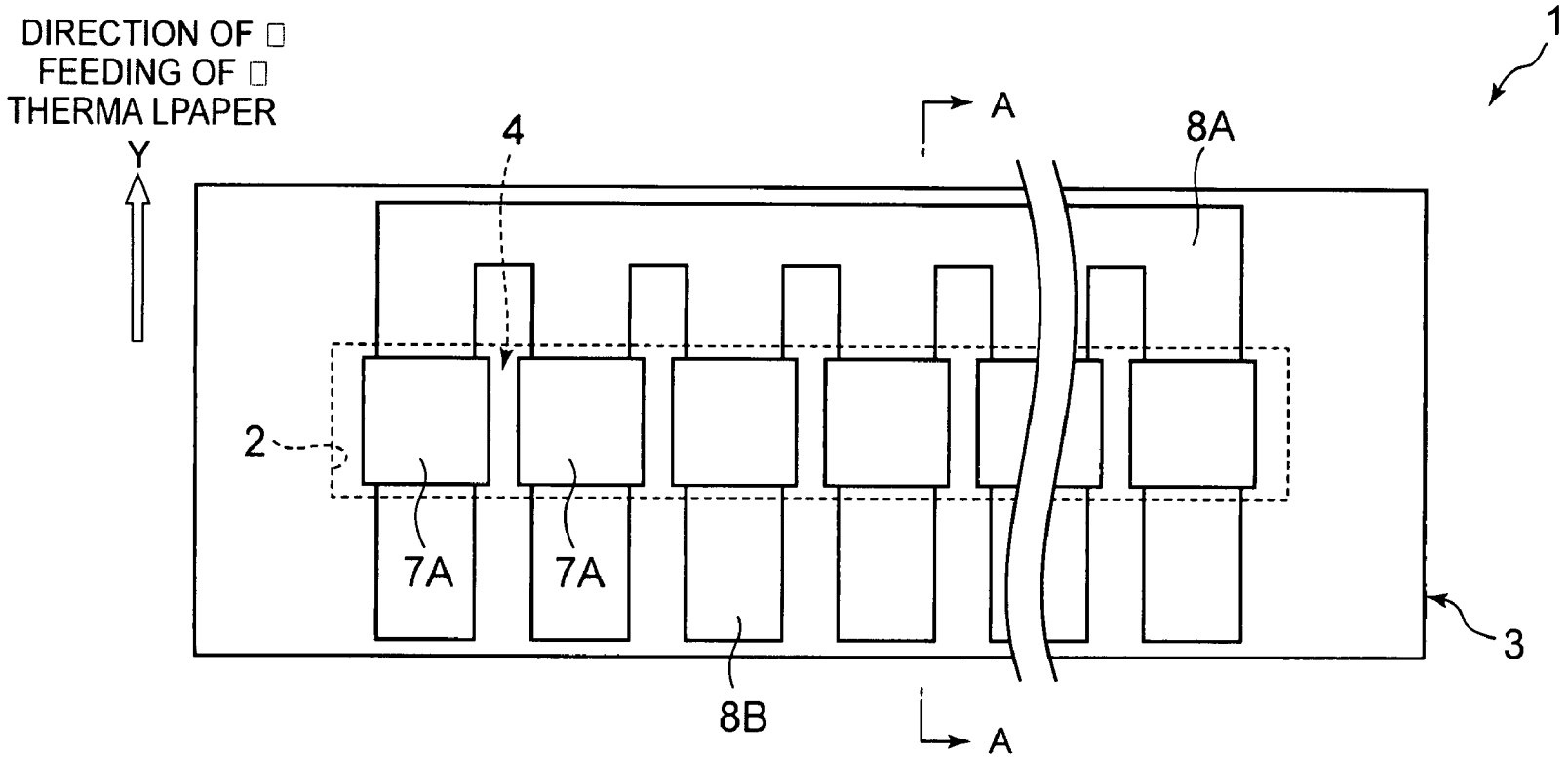
FIG. 2 is a plan view illustrating a thermal head of FIG. 1 viewed from a protective film side.

As illustrated in FIG. 2, in the thermal head 1, a plurality of heating resistors 7 and electrode portions 8A and 8B are arranged in a longitudinal direction of a support substrate 3. The arrow Y indicates a direction in which the thermal paper 12 is fed by the paper feeding mechanism 17. In the top surface of the support substrate 3, there is formed a rectangular concave portion 2 extending in the longitudinal direction of the support substrate 3.

Figure 3:
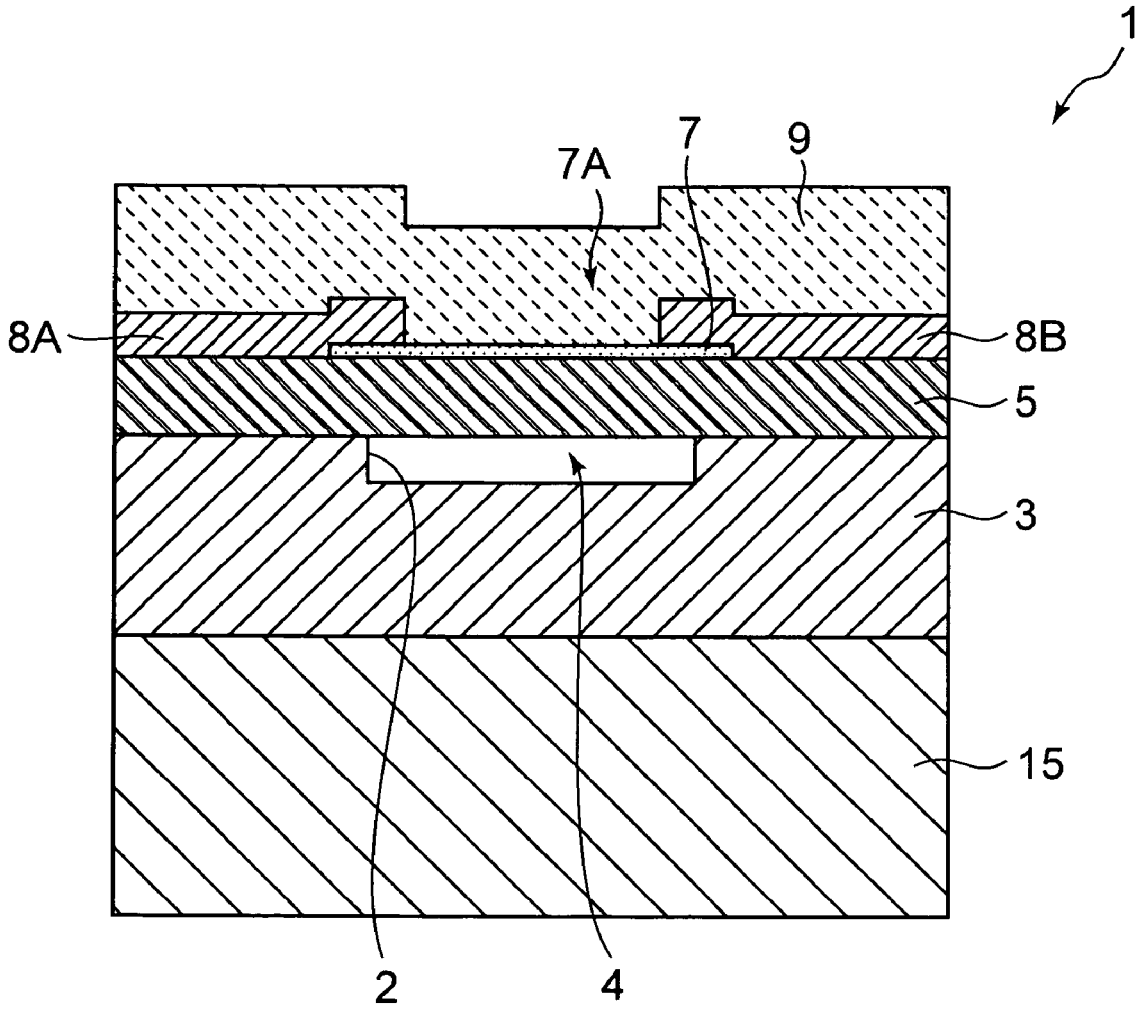
FIG. 3 is a cross-sectional view (vertical cross-sectional view) of the thermal head taken along the arrow A-A of FIG. 2.

A cross-sectional view taken along the arrow A-A of FIG. 2 is illustrated in FIG. 3.

As illustrated in FIG. 3, the thermal head 1 includes the rectangular support substrate 3 fixed onto the heat dissipation plate 15, an upper plate substrate 5 bonded onto the top surface of the support substrate 3, the plurality of heating resistors 7 provided on the upper plate substrate 5, the electrode portions 8A and 8B connected to the heating resistors 7, and a protective film 9 covering the heating resistors 7 and the electrode portions 8A and 8B to protect the heating resistors 7 and the electrode portions 8A and 8B from abrasion and corrosion.

The support substrate 3 is, for example, an insulating substrate such as a glass substrate or a silicon substrate having a thickness of approximately 300 μm to 1 mm. In the top surface of the support substrate 3, that is, the boundary surface of the upper plate substrate 5, the rectangular concave portion 2 extending in the longitudinal direction of the support substrate 3 is formed. The concave portion 2 is a cavity having, for example, a depth of about 1 μm to 100 μm, and a width of about 50 μm to 300 μm.

The upper plate substrate 5 is formed of, for example, a glass material having a thickness of about 10 μm to 100±5 μm, and functions as a heat accumulating layer which accumulates therein heat generated from the heating resistors 7. The upper plate substrate 5 is bonded to the top surface of the support substrate 3 so as to seal the concave portion 2. With the concave portion 2 being covered with the upper plate substrate 5, a hollow portion 4 is formed between the upper plate substrate 5 and the support substrate 3.

The hollow portion 4 has a connecting-through configuration opposing each of the heating resistors 7, and functions as a hollow heat insulating layer which inhibits heat generated from the heating resistors 7 from being propagated from the upper plate substrate 5 to the support substrate 3. By allowing the hollow portion 4 to function as the hollow heat insulating layer, an amount of heat which is propagated to a portion located above the heating resistors 7 and used for printing or the like may be adjusted to a value larger than an amount of heat propagated to the support substrate 3 via the upper plate substrate 5 located under the heating resistors 7, and an improvement in thermal efficiency of the thermal head 1 may be achieved.

The heating resistors 7 are each provided so as to straddle the concave portion 2 in its width direction on an upper end surface of the upper plate substrate 5, and are arranged at predetermined gaps in the longitudinal direction of the concave portion 2. In other words, each of the heating resistors 7 is provided to be opposed to the hollow portion 4 through the upper plate substrate 5 so as to be located above the hollow portion 4.

The electrode portions 8A and 8B cause the heating resistors 7 to generate heat, and are formed of a common electrode 8A connected to one end of each of the heating resistors 7 in a direction orthogonal to the arrangement direction of the heating resistors 7, and individual electrodes 8B connected to the other end of each of the heating resistors 7. The common electrode 8A is integrally connected to all the heating resistors 7, and the individual electrodes 8B are connected to the heating resistors 7, respectively.

When voltage is selectively applied to the individual electrodes 8B, current flows through the heating resistors 7 connected to the selected individual electrodes 8B and the common electrode 8A opposed thereto, with the result that the heating resistors 7 are caused to generate heat. In this state, the thermal paper 12 is pressed by the operation of the pressure mechanism 19 against the top surface portion (printing portion) of the protective film 9 covering the heating portions of the heating resistors 7, with the result that color is developed on the thermal paper 12 and printing is performed.

Note that, of each of the heating resistors 7, an actual heating portion (hereinafter, referred to as "heating portion 7A") is a portion of each of the heating resistors 7 on which the electrode portions 8A and 8B do not overlap, that is, a portion of each of the heating resistors 7 which is a region between the connecting surface of the common electrode 8A and the connecting surface of each of the individual electrodes 8B and is located substantially directly above the hollow portion 4.

Figure 4A:
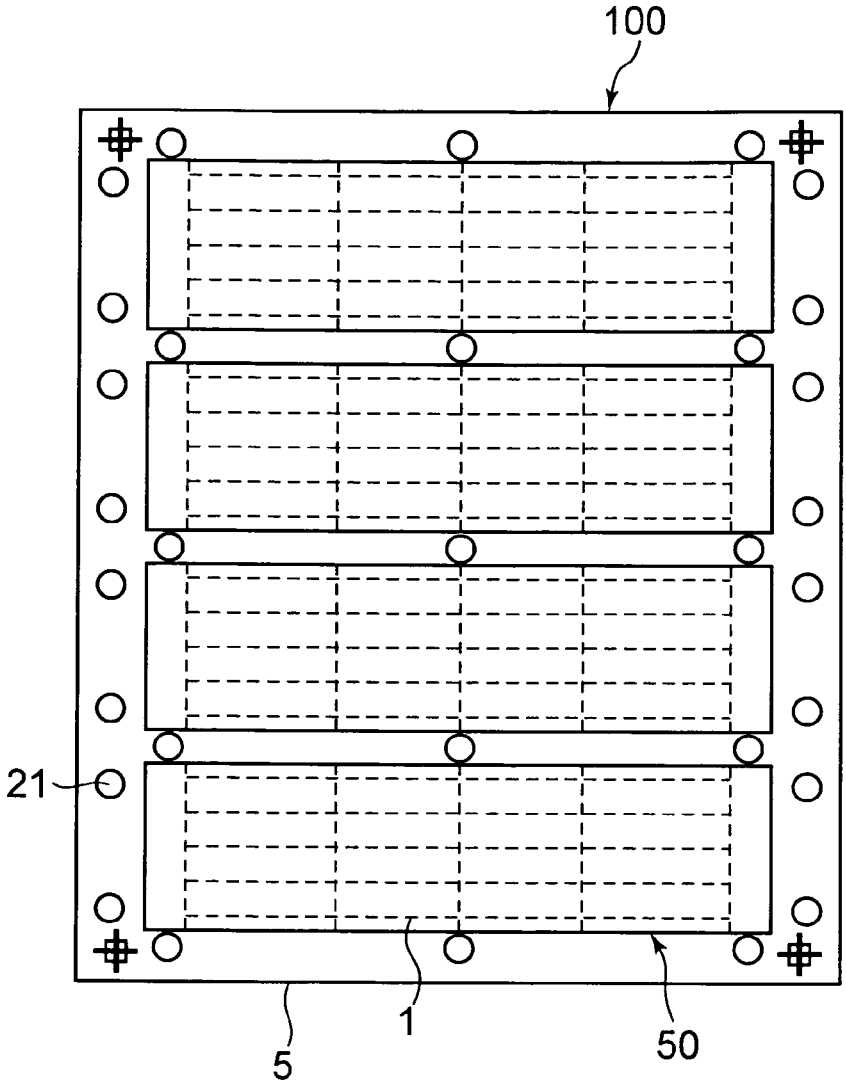
Figure 4B:
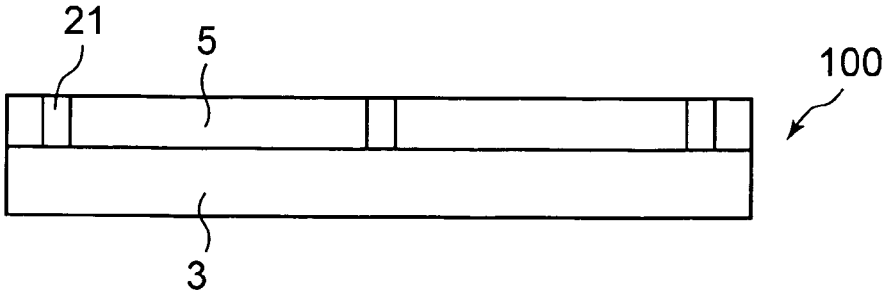

Now, a detailed structure of the upper plate substrate 5 is described using FIGS. 4A and 4B. FIG. 4A is a top view of a laminated substrate 100 in which thermal head assemblies 50 each including a plurality of the thermal heads 1 are arranged at gaps. FIG. 4B is a cross-sectional view of the laminated substrate 100 of FIG. 4A.

As illustrated in FIGS. 4A and 4B, there are provided a plurality of through holes (through portions) 21 passing through the upper plate substrate 5 in a plate thickness direction.

The plurality of through holes 21 pass through the upper plate substrate 5 from the top surface thereof to the top surface of the support substrate 3, and are provided at positions other than those of the hollow portions 4 and outside the effective range of the thermal heads 1 in the outer edge portion of the upper plate substrate 5. The through holes 21 are also provided between the adjacent thermal heads 1. Each of the through holes 21 has an inner diameter of, for example, about 1 mm to 5 mm to allow a measurement device such as a micrometer to be inserted therein to measure the thickness of the upper plate substrate 5.

The through holes 21 are provided at positions other than those of the hollow portions 4 in order to measure the distance from the top surface of the upper plate substrate 5 to the top surface (flat surface) of the support substrate 3, that is, the thickness of the upper plate substrate 5. In addition, if the through holes 21 are provided within the effective range of the thermal heads 1, stepped portions present obstacles in the thin-film processing step for the formation of the thermal heads, and cause film separation due to the sagging of a thin film in the through holes 21 or the occurrence of pattern residue resulting from a resist pool, which leads to quality degradation and a lower yield.

Hereinafter, a manufacturing method for the thermal head 1 structured as described above is described using FIG. 5.

Figure 5:
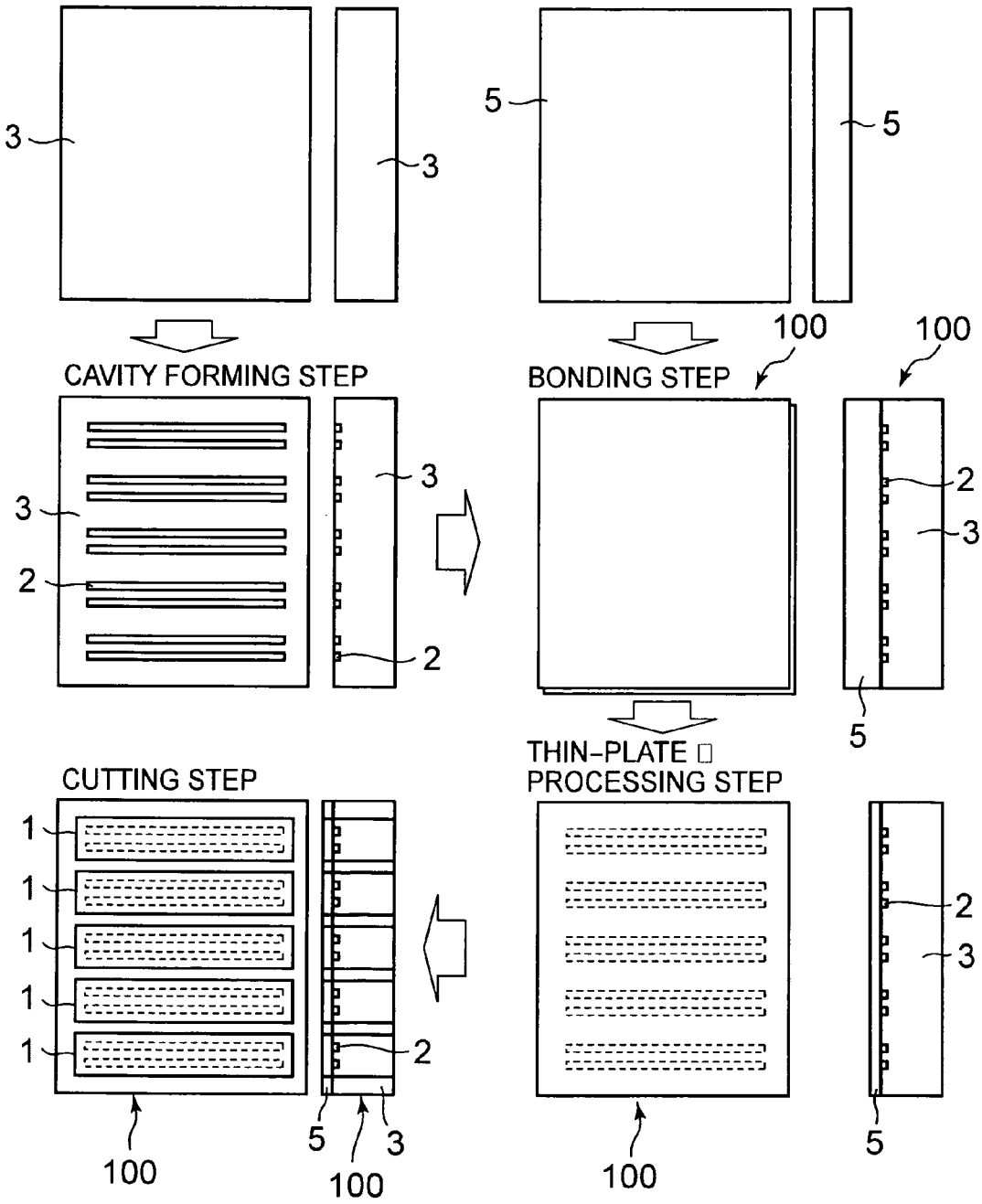
FIG. 5 is a flow chart illustrating a manufacturing method for the thermal head of FIG. 1.

As illustrated in FIG. 5, the manufacturing method for the thermal head 1 according to this embodiment includes a cavity forming step of forming the concave portions 2 in the top surface of the support substrate 3, a bonding step of bonding the top surface of the support substrate 3 to the back surface of the upper plate substrate 5, a thin-plate processing step of processing the upper plate substrate 5 bonded to the support substrate 3 into a thin plate, and a cutting step of cutting the substrate (hereinafter, referred to as "laminated substrate") 100 obtained by bonding together the upper plate substrate 5 and the support substrate 3. Each of the steps described above is specifically described hereinbelow.

First, in the cavity forming step, in the top surface of the support substrate 3, the concave portion 2 is formed so as to be opposed to a region in which the heating resistors 7 are formed. The concave portion 2 is formed in the top surface of the support substrate 3 by performing, for example, sandblasting, dry etching, wet etching, or laser machining.

When the sandblasting is performed on the support substrate 3, the top surface of the support substrate 3 is covered with a photoresist material, and the photoresist material is exposed to light using a photomask of a predetermined pattern, to thereby cure a portion other than the region in which the concave portion 2 is formed.

After that, by cleaning the top surface of the support substrate 3 and removing the photoresist material which is not cured, etching masks (not shown) having etching windows formed in the region in which the concave portion 2 is formed may be obtained. In this state, the sandblasting is performed on the top surface of the support substrate 3, and the concave portion 2 having a depth of 1 to 100 μm is formed. It is desirable that the depth of the concave portion 2 be, for example, 10 μm or more and half or less of the thickness of the support substrate 3.

Further, when etching, such as the dry etching and the wet etching, is performed, as in the case of the sandblasting, the etching masks are formed, which have the etching windows formed in the region in the top surface of the support substrate 3 in which the concave portion 2 is formed. In this state, by performing the etching on the top surface of the support substrate 3, the concave portion 2 having the depth of 1 to 100 μm is formed.

Such an etching process employs, for example, the wet etching using hydrofluoric acid-based etchant or the like, or the dry etching such as reactive ion etching (RIE) and plasma etching. Note that, as a reference example, in the case of a single-crystal silicon support substrate, the wet etching is performed, which uses the etchant such as tetramethylammonium hydroxide solution, KOH solution, and a mixed solution of hydrofluoric acid and nitric acid.

Next, in the bonding step, the back surface of the upper plate substrate 5 as a glass substrate having a thickness of, for example, about 500 to 700 μm is bonded to the top surface of the support substrate 3 formed with the concave portions 2 by fusion bonding or anodic bonding. By bonding together the support substrate 3 and the upper plate substrate 5, the concave portions 2 formed in the support substrate 3 are covered with the upper plate substrate 5 so that the hollow portions 4 are formed between the support substrate 3 and the upper plate substrate 5.

As to the upper plate substrate 5, a substrate having a thickness of not more than 100 μm is difficult to manufacture and handle, and also costly. Accordingly, instead of directly bonding an upper plate substrate, which is originally thin, to the support substrate 3, the upper plate substrate 5 having a thickness which allows easy manufacturing and handling thereof is first bonded to the support substrate 3 in the bonding step, and then the upper plate substrate 5 is processed into a desired thickness in the thin-plate processing step.

Figure 6A:
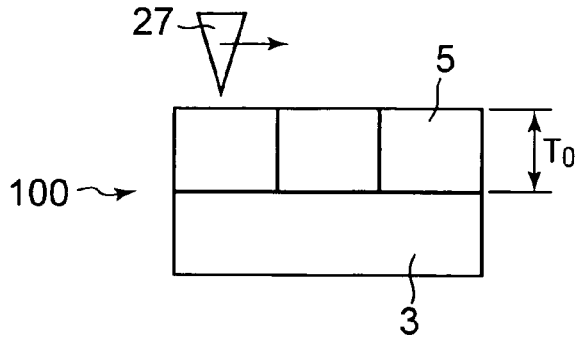
Figure 6B:
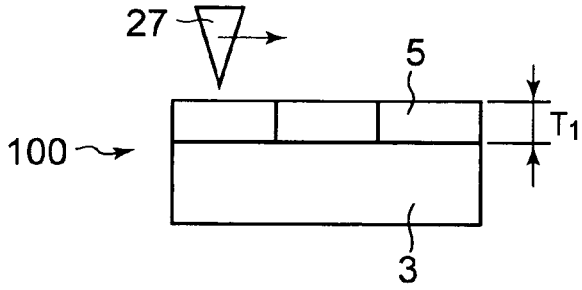
Figure 7:
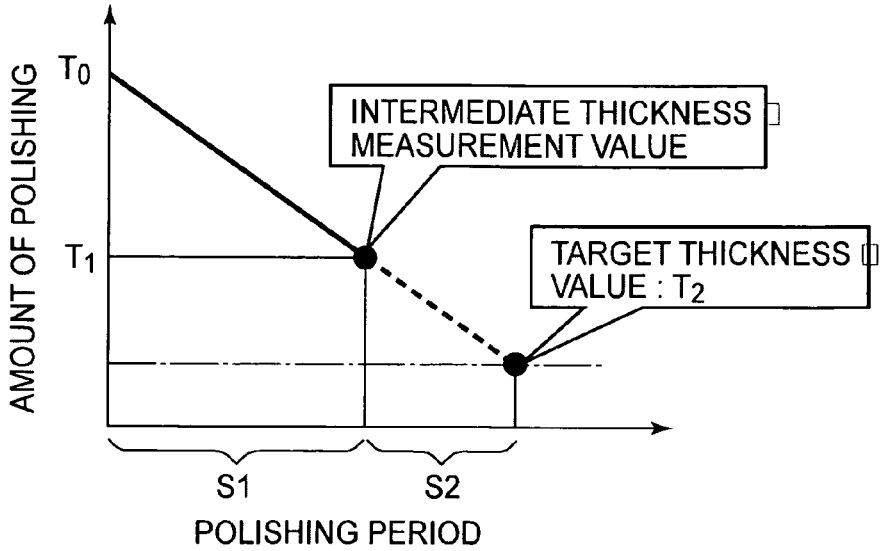
FIG. 7 is a graph illustrating a relationship between the amount of polishing and a polishing period in the thin-plate processing step of FIG. 5.

In the thin-plate processing step, as illustrated in FIGS. 6A and 6B, the upper plate substrate 5 of the laminated substrate 100 is mechanically polished with a jig 27 to be processed into a thin plate. At that time, as illustrated in FIG. 7, the thickness of the upper plate substrate 5 is measured at a time when a predetermined polishing period has elapsed so that, based on the result of the measurement, the polishing period required for the upper plate substrate 5 to have a predetermined thickness is calculated. Note that, in FIG. 7, the ordinate represents an amount of polishing (μm), and the abscissa represents an etching period (min).

Specifically, first, a measurement device such as a micrometer is inserted into the through holes 21 provided in the upper plate substrate 5 to measure a thickness T0 of the upper plate substrate 5 before the polishing is initiated. Next, as an intermediate thickness measurement value, a thickness T1 of the upper plate substrate 5 when a polishing period S1 has elapsed is measured. From the results of the measurement, a polishing period S2 necessary for adjusting the thickness of the upper plate substrate 5 to a desired value (target thickness value) T2 is calculated based on the following expression:

$$S2=S1(T1-T2)/(T0-T1).$$

The laminated substrate 100 in which the thickness of the upper plate substrate 5 has thus been adjusted to a desired value is cut in the direction in which the concave portions 2 extend to be divided into the plurality of thermal heads 1 in the cutting step.

Next, in each of the thermal heads 1 thus resulting from the division, the heating resistor 7, the common electrode 8A, the individual electrode 8B, and the protective film 9 are successively formed on the upper plate substrate 5. The heating resistor 7, the common electrode 8A, the individual electrode 8B, and the protective film 9 may be formed using a known manufacturing method for the conventional thermal head.

Specifically, a thin film is formed from a heating resistor material such as a Ta-based material or a silicide-based material on the upper plate substrate 5 by a thin film forming method such as sputtering, chemical vapor deposition (CVD), or vapor deposition. The thin film of a heating resistor material is molded by lift-off, etching, or the like to form the heating resistors 7 having a desired shape.

Subsequently, as in the heating resistor forming step, the film formation with use of a wiring material such as Al, Al—Si, Au, Ag, Cu, and Pt is performed on the upper plate substrate 5 by using sputtering, vapor deposition, or the like. Then, the film thus obtained is formed by lift-off or etching, or the wiring material is screen-printed and is, for example, burned thereafter, to thereby form the common electrode 8A and the individual electrodes 8B which have the desired shape. Note that, the heating resistors 7, the common electrode 8A, and the individual electrodes 8B are formed in an appropriate order.

In the patterning of a resist material for the lift-off or etching for the heating resistors 7 and the electrode portions 8A and 8B, the patterning is performed on the photoresist material by using a photomask.

After the formation of the heating resistors 7, the common electrodes 8A, and the individual electrodes 8B, the film formation with use of a protective film material such as $SiO_2$, $Ta_2O_5$, SiAlON, $Si_3N_4$, or diamond-like carbon is performed on the upper plate substrate 5 by sputtering, ion plating, CVD, or the like, to thereby form the protective film 9. Thus, the thermal head 1 illustrated in FIG. 2 and FIG. 3 is manufactured.

As described above, in the thermal head 1 according to this embodiment, the upper plate substrate 5 provided with the heating resistor 7 functions as the heat accumulating layer which accumulates therein heat generated from the heating resistor 7. The concave portion 2 formed in the top surface of the support substrate 3 forms the hollow portion 4 between the support substrate 3 and the upper plate substrate 5 when the support substrate 3 and the upper plate substrate 5 are bonded together. The hollow portion 4 is formed in a region opposing the heating resistor 7, and functions as a heat insulating layer which shuts off heat generated from the heating resistor 7. Therefore, in the thermal head 1 according to this embodiment, heat generated from the heating resistor 7 may be inhibited from being propagated to the support substrate 3 via the upper plate substrate 5 to be dissipated, and the use ratio of heat generated from the heating resistor 7, that is, the thermal efficiency of the thermal head 1 may be improved.

In addition, in the upper plate substrate 5 of the thermal heads 1 according to this embodiment, the through holes 21 passing through the upper plate substrate 5 from the top surface thereof to the top surface of the support substrate 3 in the plate thickness direction are provided at positions other than those of the concave portions 2. Accordingly, when the laminated substrate 100 obtained by bonding together the support substrate 3 and the upper plate substrate 5 is processed into a thin plate by polishing or the like, by inserting a measurement device such as a micrometer into the through holes 21, the thickness of only the upper plate substrate 5 may be measured.

Figure 8A:
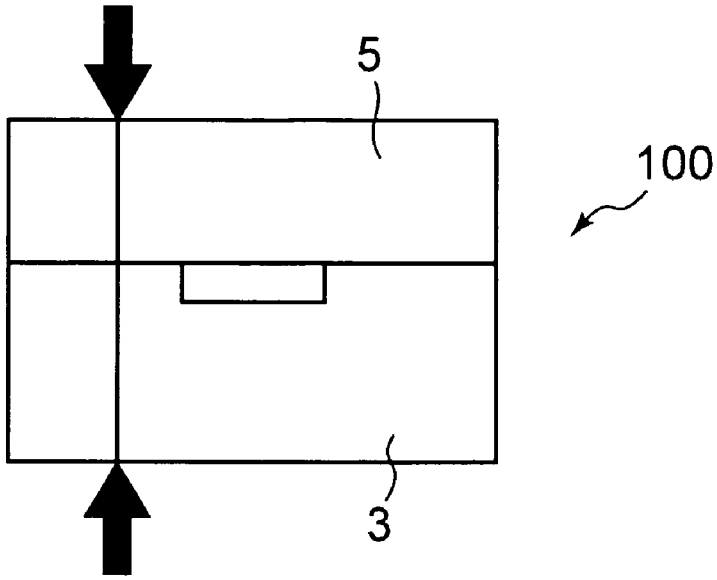
FIG. 8A PRIOR ART
Figure 8B:
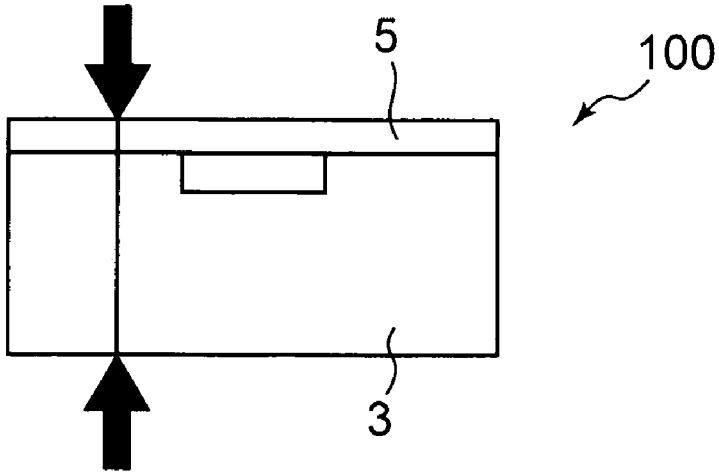
FIG. 8B PRIOR ART

In the conventional thermal head, as illustrated in FIGS. 8A and 8B, it is inevitable to measure the total thickness of the laminated substrate 100 obtained by bonding together the upper plate substrate 5 and the support substrate 3. Accordingly, variations in the thickness of the support substrate 3 are involved in the thickness of the upper plate substrate 5 to be measured. This results in the problem of a reduction in accuracy of measuring the thickness of the upper plate substrate 5. There is another problem that, at the time of measurement, the thickness of only the periphery of the laminated substrate 100 may be measured.

In contrast, in the thermal head 1 according to this embodiment, it is possible to measure the thickness of only the upper plate substrate 5, which greatly affects the thermal efficiency of the thermal head 1, instead of measuring the total thickness of the laminated substrate 100 as practiced conventionally. This may prevent variations in the thickness of the lower plate substrate from being involved in the thickness of the upper plate substrate 5 during the measurement of the thickness of the upper plate substrate 5, to thereby improve the accuracy of the measurement. Therefore, it is possible to adjust the thickness of the upper plate substrate 5 to an appropriate value to ensure the strength thereof, and improve the thermal efficiency of the thermal head 1 to allow a reduction in amount of energy required for printing.

Figure 9A:
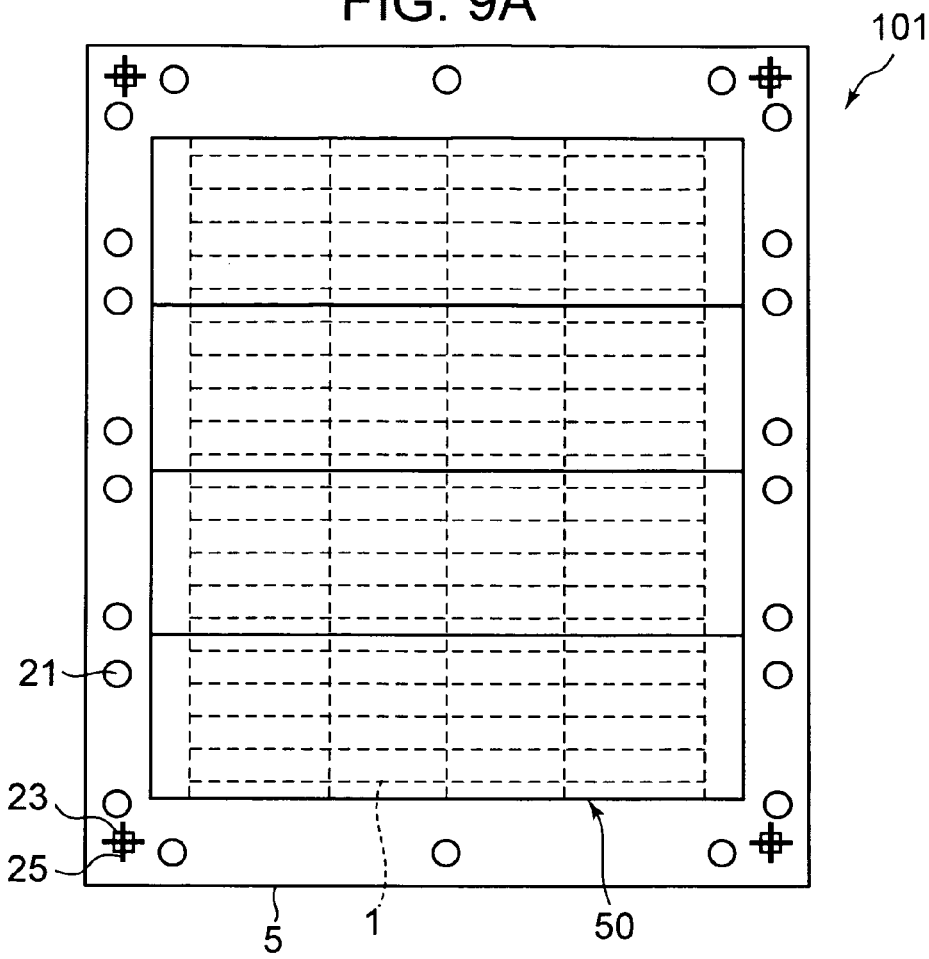
Figure 9B:
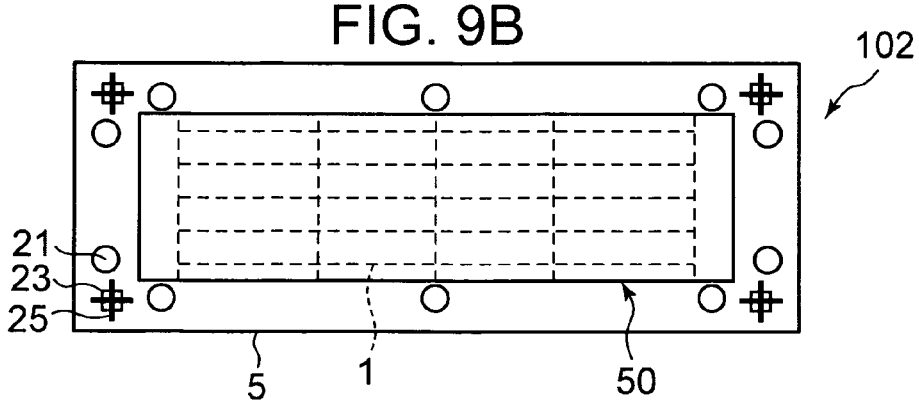
Figure 9C:
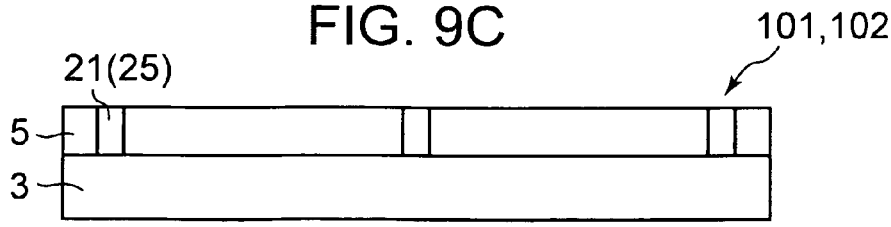

Note that, as illustrated in FIGS. 9A and 9B, the thermal head 1 of this embodiment is applicable to laminated substrates 101 and 102. FIG. 9A illustrates the laminated substrate 101 in which the thermal head assemblies 50 each including the plurality of thermal heads 1 are arranged in adjacent relation with no gap provided therebetween. FIG. 9B illustrates the laminated substrate 102 in which the single thermal head assembly 50 including the plurality of thermal heads 1 is provided. FIG. 9C illustrates a cross-sectional view thereof. Also in those examples, as illustrated in FIGS. 9A and 9B, the through holes 21 are provided at positions other than those of the hollow portions 4 and outside the effective range of the thermal heads 1, and hence it is possible to measure the thickness of only the upper plate substrate 5 by inserting a measurement device such as a micrometer into the through holes 21.

Second Embodiment

A second embodiment of the present invention is described hereinbelow. Note that, in the second and subsequent embodiments, a description of matters common to the embodiment described above is omitted, and different matters are mainly described.

Figure 11:
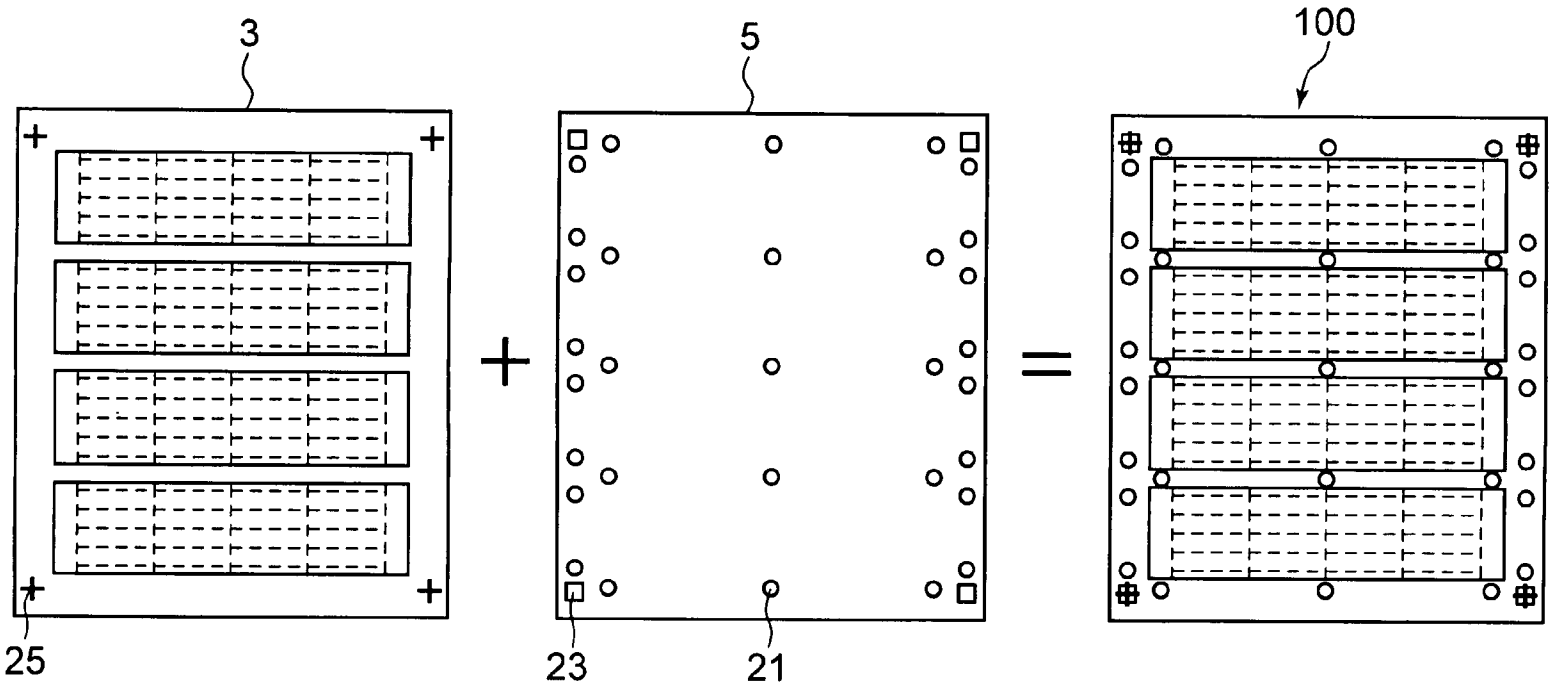
FIG. 11 is a plan view illustrating a state of bonding between an upper plate substrate and a support substrate in a thermal head according to a second embodiment of the present invention.

As illustrated in FIG. 11, in a thermal head 1 according to this embodiment, through holes 23 passing through the upper plate substrate 5 in the plate thickness direction are provided in four corners of the upper plate substrate 5. Similarly to the through holes 21 described above, the through holes 23 pass through the upper plate substrate 5 from the top surface thereof to the top surface of the support substrate 3, and are used to align the support substrate 3 with the upper plate substrate 5 when the support substrate 3 and the upper plate substrate 5 are to be bonded together.

Figure 12A:
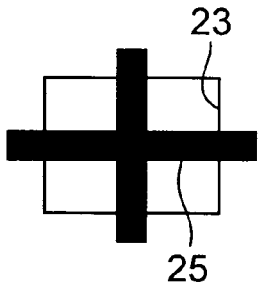
Figure 12B:
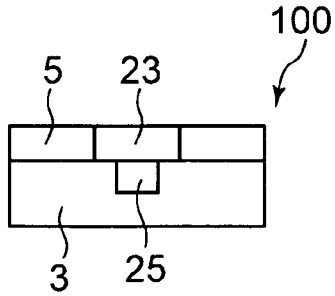

In the top surface of the support substrate 3, cavities (marks) 25 for alignment are provided at positions corresponding to the through holes 23, as illustrated in FIG. 11. Therefore, as illustrated in FIGS. 12A and 12B, by bonding together the upper plate substrate 5 and the support substrate 3 so as to align the through holes 23 of the upper plate substrate 5 with the cavities 25 of the support substrate 3, the alignment between the upper plate substrate 5 and the support substrate 3 may be accomplished with high accuracy.

Figure 10:
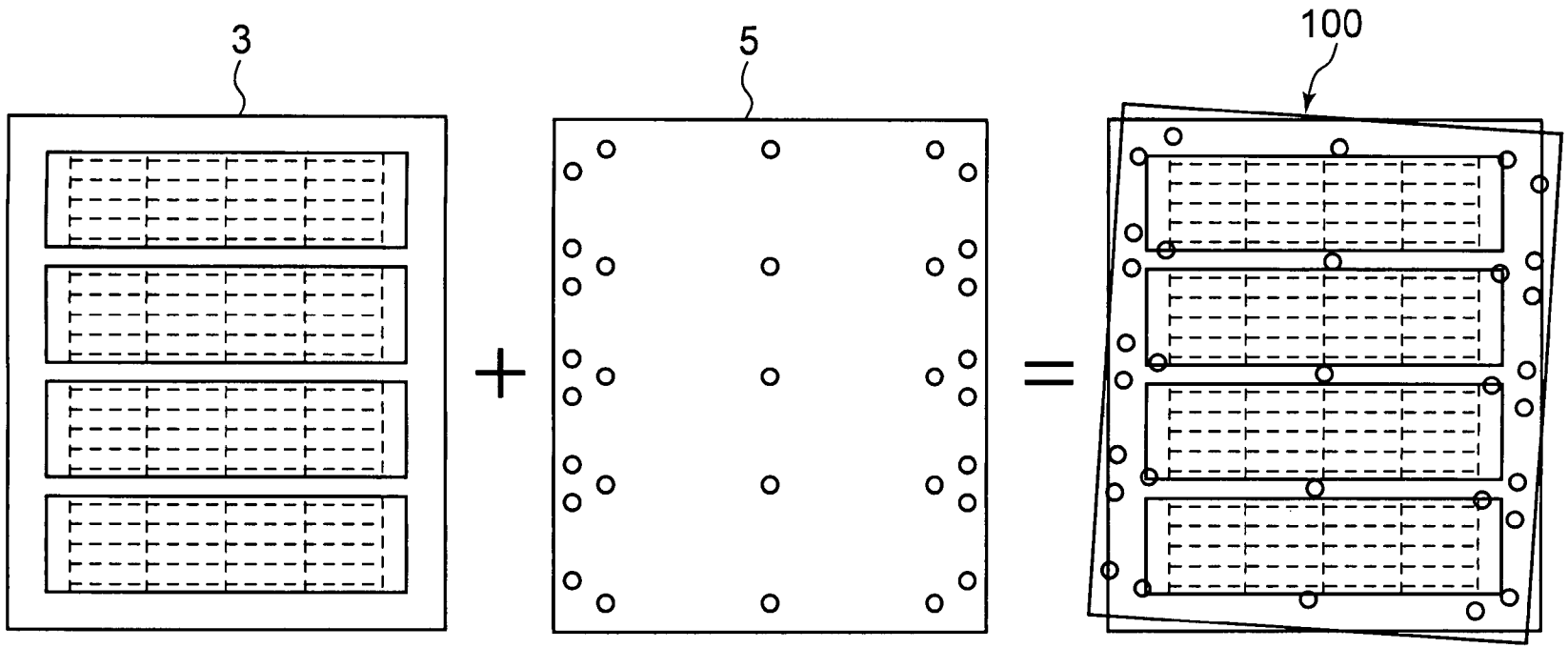
FIG. 10 PRIOR ART
FIG. 10 is a plan view illustrating a state of bonding between an upper plate substrate and a support substrate in the conventional thermal head.

In the conventional thermal head, as illustrated in FIG. 10, a substrate having a shape of substantially the same size as or slightly smaller than that of the support substrate 3 is used as the upper plate substrate 5, and aligned with the support substrate 3 based on their outer shapes, to be bonded thereto. However, due to misalignment during the bonding and the difference sizes of the substrates, it is difficult to bond the upper plate substrate 5 to a predetermined position on the support substrate 3 with regard to the cavity pattern thereof (positions of the concave portions 2).

In contrast, according to the thermal head 1 of this embodiment, the alignment between the support substrate 3 and the upper plate substrate 5 may be achieved with high accuracy, and the hollow portions 4 formed between the support substrate 3 and the upper plate substrate 5 may be aligned with high accuracy with the heating resistors 7 provided on the upper plate substrate 5. This may improve the heat insulating performance owing to the hollow portion 4, and improve the thermal efficiency of the thermal head 1.

Third Embodiment

A third embodiment of the present invention is described hereinbelow.

Figure 13A:
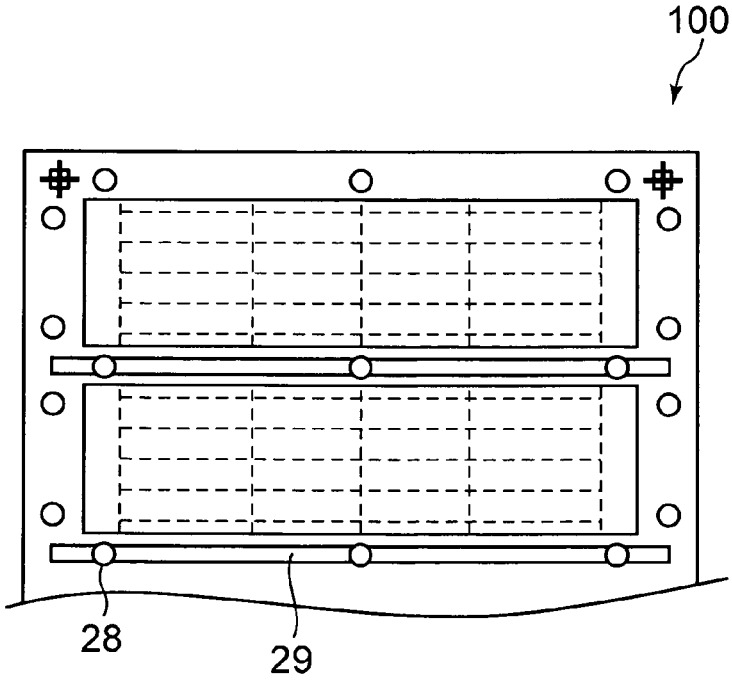
Figure 13B:
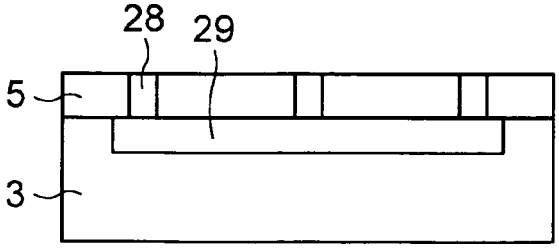

As illustrated in FIGS. 13A and 13B, in a thermal head 1 according to this embodiment, in the upper plate substrate 5, air vents 28 passing through the upper plate substrate 5 in the plate thickness direction are provided at positions other than those of the thermal heads 1. On the other hand, in the top surface of the support substrate 3, grooves 29 are formed at positions corresponding to the air vents 28 of the upper plate substrate 5.

Figure 14A:
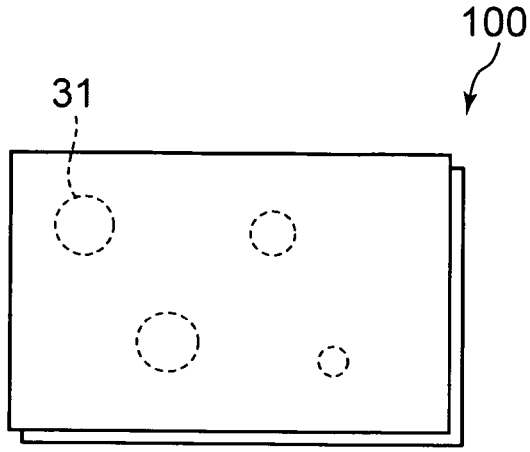
FIG. 14A PRIOR ART
Figure 14B:
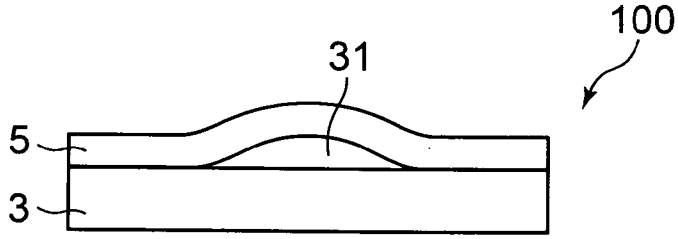
FIG. 14B PRIOR ART

As illustrated in FIGS. 14A and 14B, the conventional thermal head has a problem that air bubbles (voids) 31 are formed between the support substrate 3 and the upper plate substrate 5 to degrade the adhesion between the support substrate 3 and the upper plate substrate 5. Conventionally, when the support substrate 3 and the upper plate substrate 5 are bonded together, the bonding is performed stepwise by pressing the support substrate 3 and the upper plate substrate 5 against each other from the end portions thereof first in such a manner as to push out the air bubbles 31 so that the air bubbles 31 are not formed between the substrates. However, within the wide range of the substrate, the occurrence of the air bubbles 31 of a given size in a given amount cannot be avoided by any means.

Figure 15:
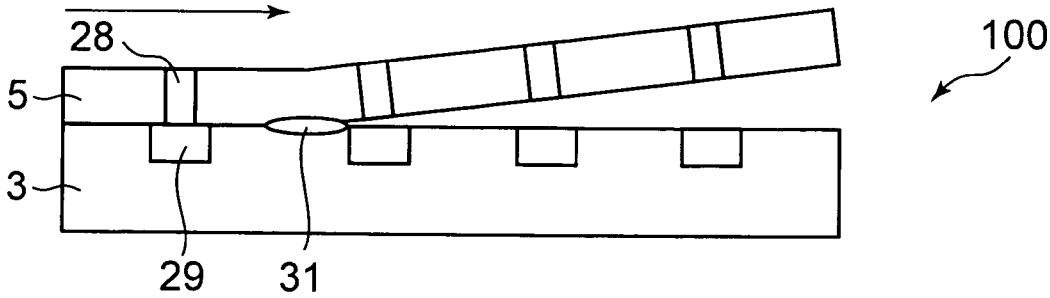
FIG. 15 is a cross-sectional view for illustrating a bonding step for a thermal head of FIGS. 13A and 13B.

In contrast, according to the thermal head 1 of this embodiment, the air bubbles 31 sandwiched between the support substrate 3 and the upper plate substrate 5 may be discharged from the air vents 28 formed in the upper plate substrate 5, as illustrated in FIG. 15. This allows the support substrate 3 and the upper plate substrate 5 to be brought into closer contact with each other at a portion other than the hollow portions 4. As a result, it is possible to prevent the breakage or swelling of the portion with the air bubbles 31, and effect satisfactory formation of the heads.

In addition, the grooves 29 are formed in the top surface of the support substrate 3 and at positions corresponding to those of the air vents of the upper plate substrate 5. Accordingly, the air bubbles 31 sandwiched between the support substrate 3 and the upper plate substrate 5 may be discharged from the air vents 28 provided in the upper plate substrate 5 via the grooves 29 formed in the top surface of the support substrate 3 so that the adhesion between the support substrate 3 and the upper plate substrate 5 may be improved.

Fourth Embodiment

A fourth embodiment of the present invention is described hereinbelow.

In a thermal head 1 according to this embodiment, the through holes 21 are provided at cutting positions used when the assemblies of the thermal heads 1 in each of which the plurality of heating resistors 7 are provided on the upper plate substrate 5 are cut and divided into the plurality of the thermal heads 1.

Figure 16:
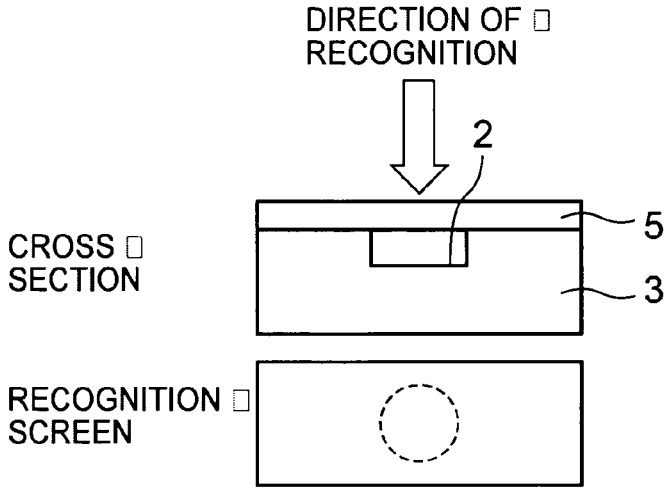
FIG. 16 PRIOR ART
FIG. 16 is a view for illustrating a cutting position in the conventional thermal head.

In the case where an effective wafer portion is cut out of a large-size glass substrate or a small-size glass substrate, the wafer is cut into a predetermined size based on the marks of the cutting positions by dicing or using a device such as a scriber. As the mark of the cutting reference positions at the time of cutting, a cavity pattern (positions of the concave portions 2) has been used conventionally, as illustrated in FIG. 16. Accordingly, to recognize the positions, the cavity pattern in the support substrate 3 has been recognized through the upper plate substrate 5 using reflected optical light. As a result, focusing is difficult due to the reflection, and contrast is so low that it is difficult to recognize the cutting positions. If the cavity pattern is excessively large, due to high-temperature heating performed in the bonding step, a gas included therein expands to cause the breakage or swelling of the cavity portions, resulting in a problem in the formation of the heads.

Figure 17:
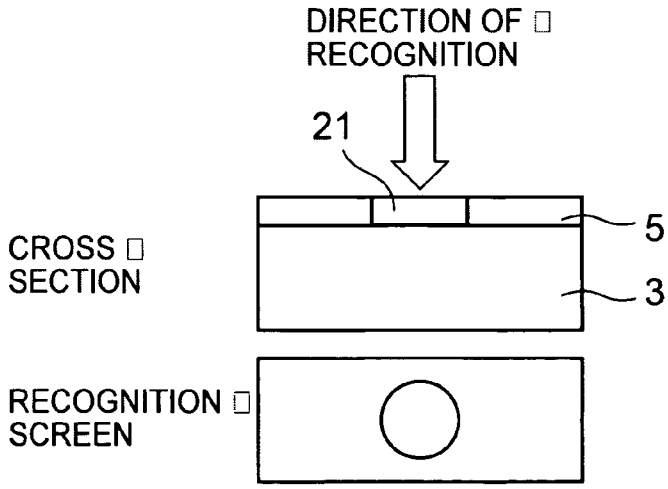
FIG. 17 is a view illustrating a cutting position in a thermal head according to a fourth embodiment of the present invention.

In contrast, according to the thermal head 1 of this embodiment, the air vents 21 are opened in the top surface of the upper plate substrate 5, as illustrated in FIG. 17, and hence the recognition of the positions thereof is easy. Therefore, by using the through holes 21 as the marks of the cutting positions used when the assemblies of the thermal heads 1 are divided into the plurality of thermal heads 1, the accuracy of cutting may be improved.

While each of the embodiments of the present invention has been described thus far in detail with reference to the drawings, a specific structure thereof is not limited to these embodiments. Design modifications and the like within the scope of the present invention are encompassed therein.

For example, in each of the embodiments described above, the concave portions 2 each having the rectangular shape extending in the longitudinal direction of the support substrate 3 are formed, and each of the hollow portions 4 has the connecting-through configuration opposing the heating resistor 7. Instead, it is also possible that mutually independent concave portions may be formed at positions opposing the respective heating portions 7A of the heating resistor 7 and along the longitudinal direction of the support substrate 3, and mutually independent hollow portions may be formed by the upper plate substrate 5 for the individual concave portions on a one-to-one basis. This allows the formation of thermal heads each including a plurality of independent hollow heat insulating layers.

The description has also been given assuming that the concave portions 2 are formed in the top surface of the support substrate 3. However, the concave portions 2 may also be formed in the back surface of the upper plate substrate 5, or formed in each of the top surface of the support substrate 3 and the back surface of the upper plate substrate 5.

The description has also been given assuming that the through holes 21 for the measurement of the thickness of the upper plate substrate 5 are circular through holes passing through the upper plate substrate 5 in the plate thickness direction. However, the through holes 21 may also be through holes each having a quadrilateral shape, an ellipsoidal shape (slit), or other arbitrary shapes. The through holes 21 may also be notches.

The description has also been given assuming that the plurality of through holes 21 for the measurement of the thickness of the upper plate substrate 5 are provided in the outer edge portion of the upper plate substrate 5. However, the through holes 21 may be provided appropriately only in portions necessary for controlling the thickness of the upper plate substrate 5. In the case where the upper plate substrate 5 may be polished to a uniform thickness, only one through hole 21, for example, may be provided appropriately.

The description has been given assuming that, in the second embodiment, the through holes 23 and the cavities 25 each for determining the positions at which the upper plate substrate 5 and the support substrate 3 are to be bonded together are provided in the four corners of the laminated substrate 100. However, the through holes 23 and the cavities 25 may be provided in two diagonal portions.

What is claimed is:

1. A thermal head, comprising: a support substrate;

an upper plate substrate having a back surface bonded to a top surface of the support substrate;

a heating resistor provided on the upper plate substrate;

a concave portion formed in a region of at least one of the top surface of the support substrate and the back surface of the upper plate substrate, the concave portion being opposed to the heating resistor; and a through portion formed in the upper plate substrate and passing through the upper plate substrate from a top surface of the upper plate substrate to the top surface of the support substrate in a plate thickness direction.

2. A thermal head according to claim 1, further comprising a mark for alignment with the upper plate substrate, the mask being provided in the top surface of the support substrate at a position corresponding to the through portion of the upper plate substrate.

3. A thermal head according to claim 1, further comprising an air vent which is formed in the upper plate substrate and which passes through the upper plate substrate in the plate thickness direction.

4. A thermal head according to claim 2, further comprising an air vent which is formed in the upper plate substrate and which passes through the upper plate substrate in the plate thickness direction.

5. A thermal head according to claim 3, further comprising a groove formed in at least one of the top surface of the support substrate and the back surface of the upper plate substrate at a position corresponding to the air vent of the upper plate substrate.

6. A thermal head according to claim 4, further comprising a groove formed in at least one of the top surface of the support substrate and the back surface of the upper plate substrate at a position corresponding to the air vent of the upper plate substrate.

7. A thermal head according to claim 1, wherein the through portion is provided at a cutting position used when a thermal head assembly in which a plurality of the heating resistors are provided on the upper plate substrate is cut and divided into a plurality of thermal heads.

8. A thermal head according to claim 2, wherein the through portion is provided at a cutting position used when a thermal head assembly in which a plurality of the heating resistors are provided on the upper plate substrate is cut and divided into a plurality of thermal heads.

9. A thermal head according to claim 3, wherein the through portion is provided at a cutting position used when a thermal head assembly in which a plurality of the heating resistors are provided on the upper plate substrate is cut and divided into a plurality of thermal heads.

10. A thermal head according to claim 4, wherein the through portion is provided at a cutting position used when a thermal head assembly in which a plurality of the heating resistors are provided on the upper plate substrate is cut and divided into a plurality of thermal heads.

11. A thermal head according to claim 5, wherein the through portion is provided at a cutting position used when a thermal head assembly in which a plurality of the heating resistors are provided on the upper plate substrate is cut and divided into a plurality of thermal heads.

12. A thermal head according to claim 6, wherein the through portion is provided at a cutting position used when a thermal head assembly in which a plurality of the heating resistors are provided on the upper plate substrate is cut and divided into a plurality of thermal heads.

13. A printer, comprising the thermal head according to claim 1.

* * * * *